US006478700B2

(12) United States Patent
Hartman

(10) Patent No.: US 6,478,700 B2
(45) Date of Patent: Nov. 12, 2002

(54) ARROW SPIN DEVICE

(76) Inventor: David Hartman, 4849 Stowe Rd., Fowlerville, MI (US) 48836

( * ) Notice: Subject to any disclaimer, the term of this patent is extended or adjusted under 35 U.S.C. 154(b) by 0 days.

(21) Appl. No.: 09/835,945

(22) Filed: Apr. 16, 2001

(65) Prior Publication Data

US 2002/0039939 A1 Apr. 4, 2002

Related U.S. Application Data

(60) Provisional application No. 60/197,245, filed on Apr. 14, 2000.

(51) Int. Cl.[7] ..... F42B 6/04
(52) U.S. Cl. ..... 473/578; 124/91
(58) Field of Search ..... 473/578; 124/90, 124/91

(56) References Cited

U.S. PATENT DOCUMENTS 2,125,591 A * 8/1938 Smith
2,209,672 A * 7/1940 Boggs
5,971,875 A * 10/1999 Hill ..... 473/578

* cited by examiner

*Primary Examiner*—John A. Ricci
(74) *Attorney, Agent, or Firm*—James M. Deimen

(57) ABSTRACT

A new device incorporated in an arrow causes the arrow to spin as it leaves the bow. The arrow spin device comprises a screw shaft which is cylindrical at the leading and trailing ends thereof and inserted in the posterior end of the arrow shaft. A rotary spin is imparted to the arrow shaft about its longitudinal axis at initial bow string release by engagement of the screw shaft with a guide integral with the arrow shaft. As the screw shaft becomes fully inserted into the arrow shaft in response to the bow string's force, the arrow shaft becomes free to rotate about anterior and posterior cylindrical surfaces on the screw shaft. Upon release from the bow string, the arrow shaft is rotating and the arrow will travel faster and with less deviation by virtue of the ballistic spin imparted. This spin allows the arrow to avoid the need for external fletching.

4 Claims, 2 Drawing Sheets

ARROW SPIN DEVICE

This application claims the benefit of provisional patent application No. 60/197,245, filed Apr. 14, 2000.

BACKGROUND OF THE INVENTION

The field of the invention pertains to arrows for archery and, in particular, to improvements to speed, accuracy, and delivered power of an archery arrow.

The standard archery arrow is a suitable length shaft with vanes or fletching affixed at the posterior end. When propelled by a bow, the arrow's flight is stabilized by virtue of the fletching's drag against air resistance. While this construction does achieve a relatively straight line of flight (except for the effect of gravity on the flight), it does so at the cost of energy loss in direct proportion to distance of flight as the air resistance is a substantially constant function of arrow flight speed.

If rotation can be imparted to the arrow, the arrow will be stabilized in a manner similar to a bullet shot from a rifled barrel firearm. Some attempts have been made to provide rotation to an arrow. U.S. Pat. No. 5,971,875 discloses a slot which drives against circumferentially arranged dimples. However, this device makes no provision for a disengagement mechanism that will allow for rotation of the arrow while the arrow is engaged in the bow string prior to release. A frequent result is the failure of the arrow at the nock and bow string interface. As shown in this patent, a form of external fletching is required to achieve rotation of the arrow upon release from the bow string.

SUMMARY OF THE INVENTION

By eliminating the fletching, there will be an increase in arrow speed and delivered energy. The increase in arrow speed will result in a straighter trajectory and enhanced accuracy.

The new arrow spin device comprises a screw shaft which is cylindrical at the leading and trailing ends thereof and inserted in the posterior end of the arrow shaft. A rotary spin is imparted to an arrow shaft about its longitudinal axis at initial bow string release by engagement of the screw shaft with a guide integral with the arrow shaft.

As the screw shaft becomes fully inserted into the arrow shaft in response to the bow strings's force, the arrow shaft becomes free to rotate about anterior and posterior cylindrical surfaces on the screw shaft. Upon release from the bow string, the arrow shaft is rotating and the arrow will travel faster and with less deviation by virtue of the ballistic spin imparted. This spin allows the arrow to avoid the need for external fletching.

DESCRIPTION OF THE PREFERRED EMBODIMENT

Figure 1B:
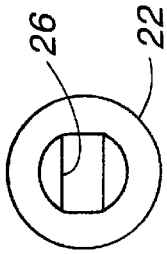
FIGS. 1A and 1B are left and right end views of the arrow nock.
Figure 1:
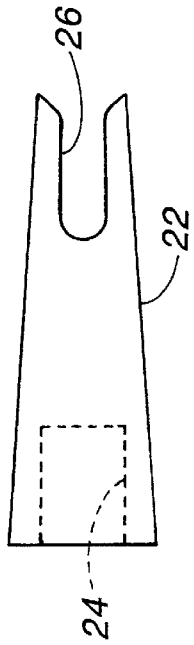
FIG. 1 is a side view of the arrow nock.
Figure 1A:
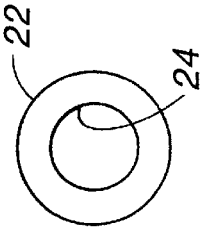
Figure 2:
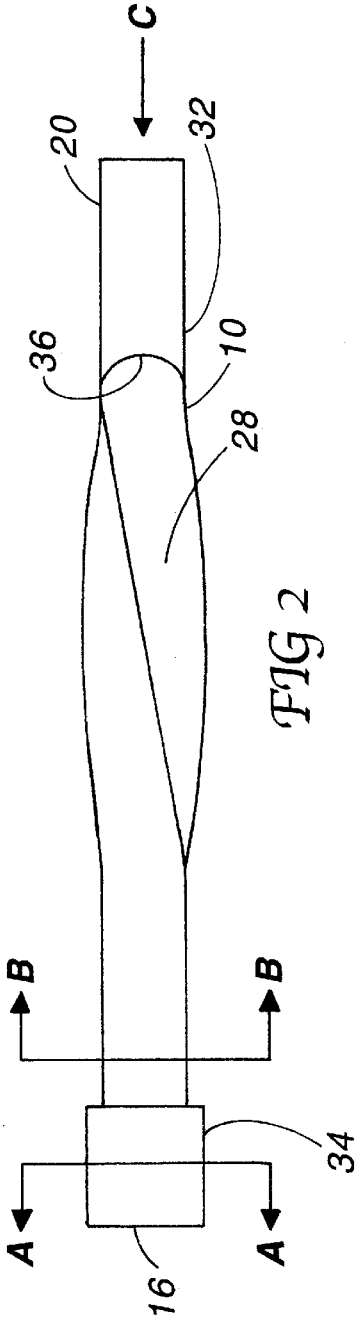
FIG. 2 is a side view of the screw shaft.
Figure 2C:
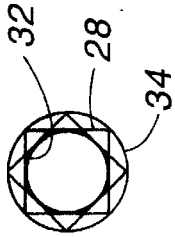
FIGS. 2A, 2B, and 2C are sections of the screw shaft taken along lines A—A, B—B and in direction C, respectively, of FIG. 2.
Figure 2B:
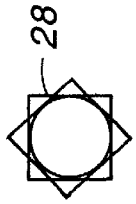
Figure 2A:
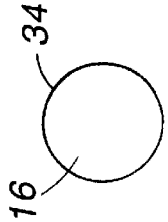
Figure 3:
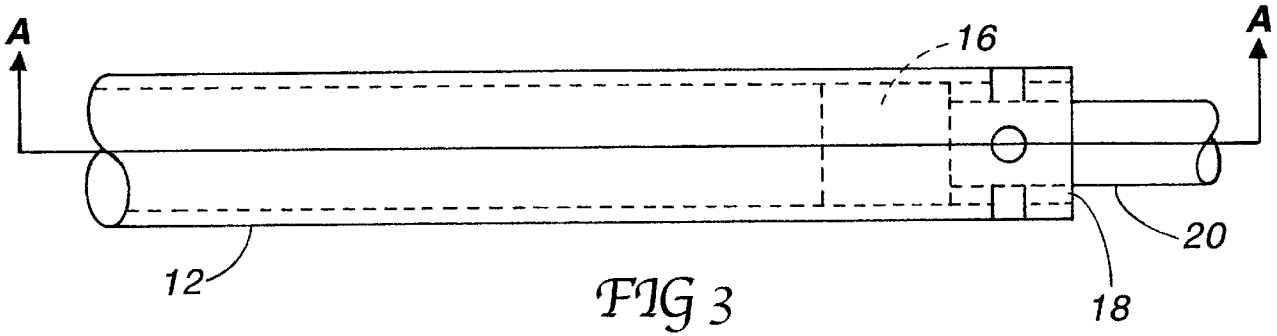
FIG. 3 is a partial side view of the posterior end of the arrow shaft.
Figure 3B:
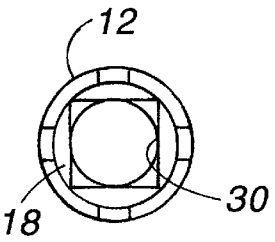
FIG. 3B is a view of FIG. 3 in direction B.
Figure 3A:
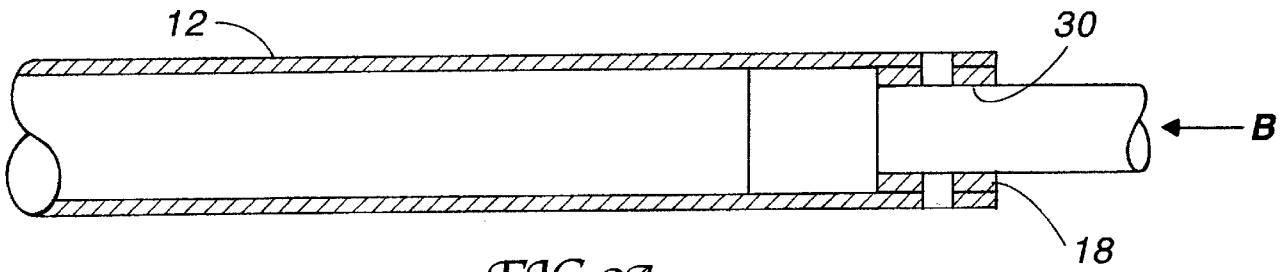
FIG. 3A is a section along line A—A of FIG. 3.
Figure 4:
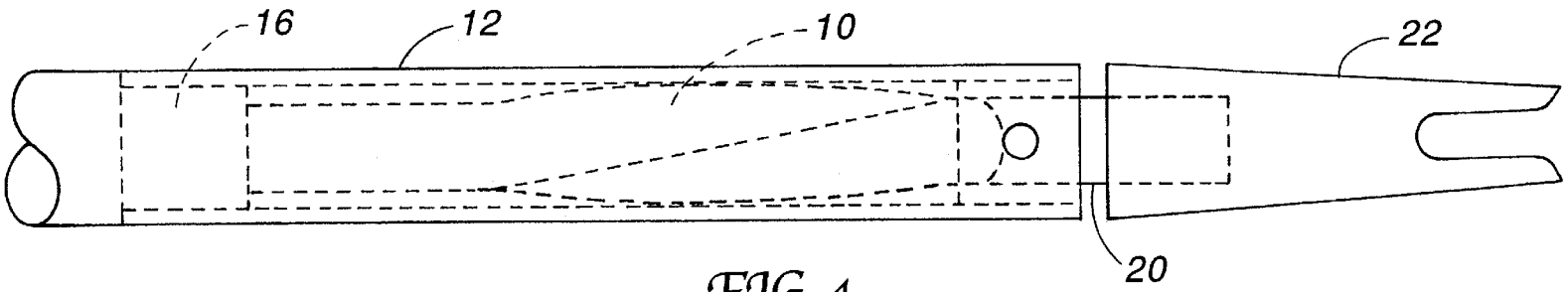
FIG. 4 is a partial side view of the arrow shaft posterior end with the screw shaft fully inserted.

Initially, the screw shaft 10 illustrated in FIG. 2 extends substantially from the hollow 12 posterior end of the arrow shaft 14 shown in FIG. 3. The larger cylindrical anterior end 16 of the screw shaft 10 cannot pass by the polyhedral rotation guide 18 in FIG. 3 thereby preventing separation of the screw shaft 10 from the arrow shaft 14. The rotation guide 18 is press fit or adhesively attached into the hollow posterior end 12 of the shaft 14. The posterior end 20 of the screw shaft 10 is press fit or adhesively attached to the nock 22 in the nock socket 24 as shown in FIG. 4.

Upon engagement of a bow string (not shown) with the nock, slot 26 and release, the bow string drives the screw shaft 10 into the arrow shaft 14 causing the cam surfaces 28 to engage the flats 30 in the rotation guide 18. Since the screw shaft 10 is restrained from rotation by the bow string in the nock slot 26 and the arrow shaft 14 possesses considerable inertia, the engagement and movement of the cam surfaces 28 relative to the flats 30 causes the arrow shaft 14 to rotate. When the screw shaft 10 reaches the limit of motion into the arrow shaft 14 as shown in FIG. 4, the cam surfaces 28 become disengaged from the flats 30 and the arrow shaft 14 is free to rotate about the anterior end 16 rotation surface 34 and posterior end 20 rotation surface 32 adjacent the posterior end 20 of the screw shaft. The diameter of the cylindrical posterior rotation surface 32 is slightly less than the minimum distance between flats 30 to provide free rotation of the arrow shaft 14.

In FIG. 2, the cam surfaces 28 and flats 30 form square arrays in cross-section and impart an initial rotation of 90° to the arrow shaft 14. The configuration of the cam surfaces 28 and the flats 30 may be varied to provide other degrees of initial rotation to the arrow shaft 14. The free rotation of the arrow shaft 14 on the anterior 34 and posterior 32 rotation surfaces upon full insertion of the screw shaft 10 in the arrow shaft occurs much prior to disengagement of the bow string from the nock slot 26 at the termination of bow string travel. Slight chamfering at 36 on the screw shaft 10 resists re-insertion of the cam surfaces 28 into the flats 30 if there should occur momentary hang-up upon separation of the bow string from the nock slot 26 as the arrow leaves the bow.

What is claimed is:

1. An arrow spinning device comprising:

a screw shaft with anterior and posterior rotation surfaces and at least one camming surface, said camming surface between the anterior and posterior rotation surfaces, an arrow shaft, a rotation guide affixed to the arrow shaft and having a guide surface adapted to engage said camming surface during axial movement of the screw shaft relative to the arrow shaft, and said arrow shaft freely rotatable on said screw shaft when the screw shaft is at at least one extreme of axial movement relative to the arrow shaft.

2. The arrow spinning device of claim 1 wherein the rotation guide comprises a stop preventing extraction of the screw shaft from the arrow shaft.

3. The arrow spinning device of claim 1 wherein the rotation guide comprises a rotation surface engageable with at least one of the screw shaft rotation surfaces.

4. The method of applying rotation to an arrow comprising the steps of:

applying bow string force to the nock of an arrow, said nock attached to a cam surface and said cam surface restrained from rotation by the engagement of the nock slot with the bow string, and in response to the force on the nock, driving the cam surface against a complementary surface of a rotation guide causing the rotation guide and arrow attached thereto to rotate relative to the nock and cam surface, and upon completion of driving engagement of the cam surface against the rotation guide allowing free rotation of the arrow relative to the nock.

* * * * *